US005089216A

United States Patent [19]

Schlonski et al.

[11] Patent Number: 5,089,216

[45] Date of Patent: Feb. 18, 1992

[54] SYSTEM FOR CHEMICAL DECONTAMINATION OF NUCLEAR REACTOR PRIMARY SYSTEMS

[75] Inventors: James S. Schlonski; Michael F. McGiure; Gary J. Corpora, all of Monroeville, Pa.

[73] Assignee: Westinghouse Electric Corp., Pittsburgh, Pa.

[21] Appl. No.: 621,120

[22] Filed: Nov. 26, 1990

[51] Int. Cl.[5] ..... G21C 19/42

[52] U.S. Cl. ..... 376/308; 376/298; 376/310; 376/307; 376/309

[58] Field of Search ..... 376/309, 310, 298, 299, 376/307, 308

[56] References Cited

U.S. PATENT DOCUMENTS 3,222,255 12/1965 Maldague ..... 376/310
3,438,431 4/1969 Dreyer et al. ..... 376/309
3,910,817 10/1975 Frumerman et al. ..... 376/300
3,976,541 8/1976 Stiteler et al. ..... 376/310
4,123,324 10/1978 Sanada et al. ..... 376/313
4,647,425 3/1987 Battaglia et al. ..... 376/308

FOREIGN PATENT DOCUMENTS 53-122097 10/1978 Japan ..... 371/310
2085215A 8/1980 United Kingdom .

*Primary Examiner*—Brooks H. Hunt
*Assistant Examiner*—Meena Chelliah

[57] ABSTRACT

A unique and optimum nuclear steam supply system operating configuration for integration of a chemical decontamination system is disclosed. The chemical decontamination system is connected to, and returns to, the residual heat removal system downstream of a residual heat removal heat exchanger, thereby utilizing the residual heat removal system to control the temperature of process fluids entering the decontamination system. A reactor coolant pump or pumps generates heat for the chemical processes as needed and a nitrogen blanket within the primary system pressurizer is utilized for system pressure control.

20 Claims, 1 Drawing Sheet

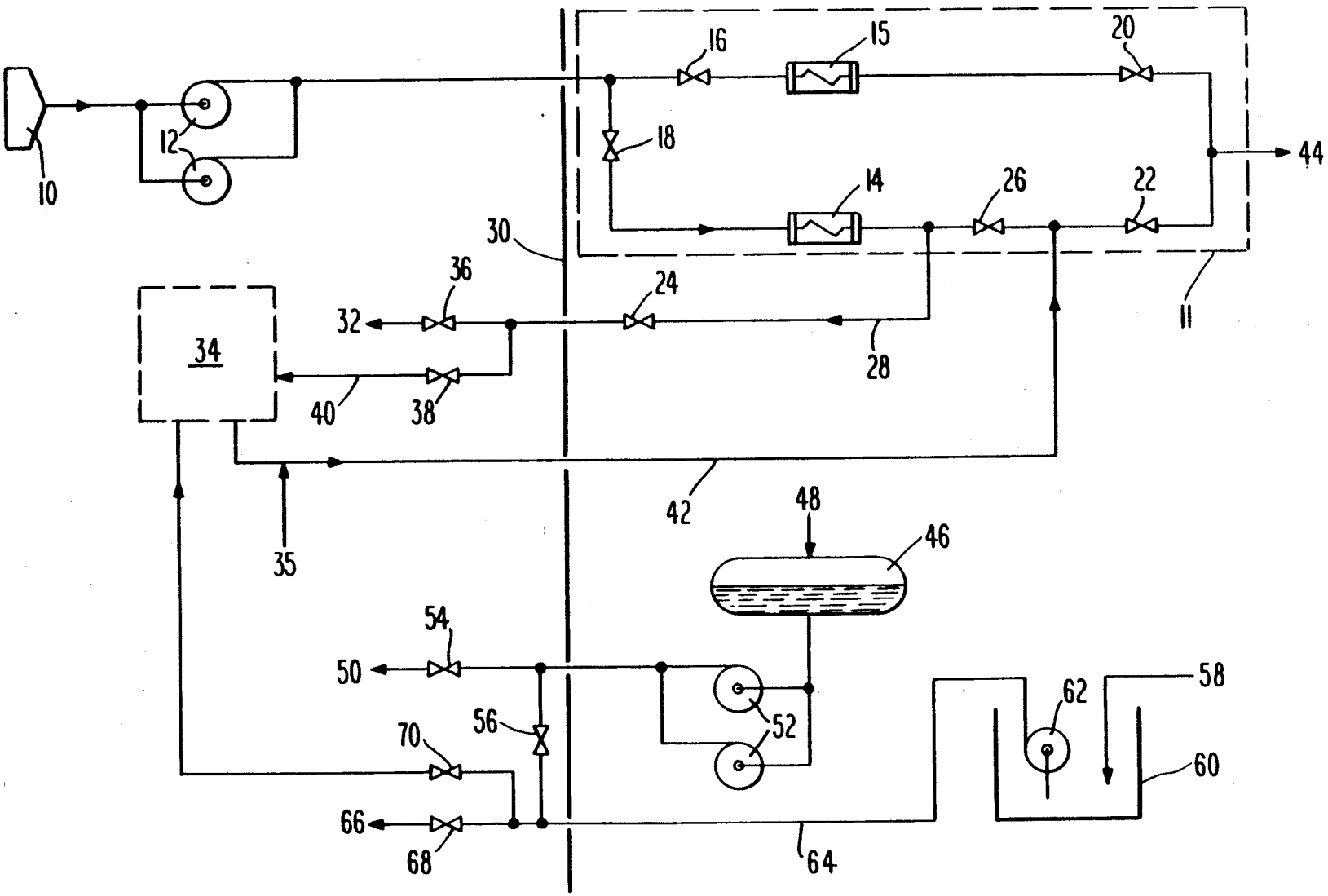
44
11
20
22
26
15
14
28
16
18
24
30
36
38
32
40
12
10
34
35
42
46
48
52
58
60
62
64
56
54
50
70
68
66

SYSTEM FOR CHEMICAL DECONTAMINATION OF NUCLEAR REACTOR PRIMARY SYSTEMS

BACKGROUND OF THE INVENTION

1. Field of the Invention

The present invention relates to the field of decontamination of nuclear reactor primary systems. More specifically, it relates to a unique method of integrating a chemical injection and clean-up sub-system into a nuclear reactor primary system for chemical decontamination of the entire primary system.

2. Description of the Prior Art

The problem of excessive personnel exposures caused by high background radiation levels in a nuclear reactor primary system, such as in pressurized water reactor (PWR) systems, and the resultant economic cost of requiring personnel rotation to minimize individual exposure is significant at many nuclear plants. These background levels are principally due to the buildup of corrosion products in certain areas of the plant. The buildup of corrosion products exposes workers to high radiation levels during routine maintenance and refueling outages. The long term prognosis is that personnel exposure levels will continue to increase.

As a nuclear power plant operates, the surfaces in the core and primary system corrode. Corrosion products, referred to as crud, are activated by transport of the corroded material to the core region by the reactor coolant system (RCS). Subsequent release of the activated crud and redeposition elsewhere in the system produces radiation fields in piping and components throughout the primary system, thus increasing radiation levels throughout the plant. The activity of the corrosion product deposits is predominately due to Cobalt 58 and Cobalt 60. It is estimated that 80–90% of personnel radiation exposure can be attributed to these elements.

One way of controlling worker exposure, and of dealing with this problematic situation, is to periodically decontaminate the nuclear steam supply system using chemicals, thereby removing a significant fraction of the corrosion product oxide films. Prior techniques had done very little to decontaminate the primary system as a whole, typically focusing only on the heat exchanger (steam generator) channel heads.

Two different chemical processes, referred to as LOMI (developed in England under a joint program by EPRI and the Central Electricity Generating Board) and CAN-DEREM (developed by Atomic Energy of Canada, Ltd.), have been used for small scale decontamination in the past. These processes are multi-step operations, in which various chemicals are injected, recirculated, and then removed by ion-exchange. Although the chemicals are designed to dissolve the corrosion products, some particulates are also generated. One method of chemical decontamination, focusing on the chemistry of decontamination, is disclosed in U.K. Patent Application No. GB 2 085 215 A (Bradbury et al.). There is little disclosure, however, of the methodology to be used in applying that chemistry to system decontamination.

While these chemical processes had typically been used on only a localized basis, use of these chemical processes has now been considered by the inventors herein for possible application on a large scale, full system chemical decontamination. Consequently, there is now a need for a subsystem design that efficiently integrates the chemical decontamination process into the current types of nuclear reactor primary systems. Such an integration will necessarily have to meet the requirements of pressure and temperature used in the chemical decontamination, requirements that had not previously been necessary to have been met since full system decontamination had not been undertaken.

While some work has been done in the boiling water reactor (BWR) programs, the BWR scenarios examined by those in the field involved decontaminating fuel assemblies in sipping cans employing commercial processes at off-normal decontamination process conditions with little regard for the effects of temperature, pressure, and flow that would be mandated by an actual application of the process to the full RCS.

The estimated collective radiation dose savings over a 10-year period following decontamination is on the order of 3500–4500 man rem, depending upon whether or not the fuel is removed during decontamination. At any reasonable assigning of cost per man-rem, the savings resulting from reduced dose levels will be in the tens of millions of dollars.

As a result of the examination of potential full system decontamination, a need now exists for an effective and economic method for integrating a chemical decontamination system into current primary systems.

SUMMARY OF THE INVENTION

The present invention is directed to a chemical decontamination system to be used in conjunction with a nuclear reactor primary system to achieve full primary system decontamination. To this end, a chemical decontamination system is integrated with a nuclear reactor primary system by utilizing the residual heat removal sub-system. Processed fluids, after passing through one of the residual heat removal heat exchangers, are diverted to the chemical decontamination system. After passing through the decontamination system, wherein the fluid is decontaminated and/or decontamination chemicals are injected into the fluid stream, the fluid stream is returned to the residual heat removal system downstream of the location of initial diversion.

In this manner, the residual heat removal pumps and heat exchangers can be utilized to assist the chemical decontamination process, both in terms of fluid flow and temperature control.

Typically, one or more reactor coolant pumps will be needed to augment the residual heat removal pumps during chemical decontamination. Therefore, the pressure within the system must be maintained above the minimum required for operation of the reactor coolant pump. This is accomplished by use of a nitrogen blanket in the primary system pressurizer.

Additionally, various fluid streams collected from seal leakages and equipment drains can be optimally fed to the chemical decontamination system and, thereafter, reinjected into the primary system along with the other process fluids or removed with the decontamination wastes.

Accordingly, it is an object of the present invention to provide a method for integrating a chemical decontamination system into a nuclear reactor primary system to economically and chemically decontaminate substantially the entirety of the nuclear reactor primary system. These and further objects and advantages will be apparent to those skilled in the art in connection with the detailed description of the invention that follows.

BRIEF DESCRIPTION OF THE DRAWING

The single FIGURE is a schematic flow diagram illustrating an embodiment of the apparatus of the present invention.

DETAILED DESCRIPTION OF THE PREFERRED EMBODIMENTS

Because critical path down time currently costs up to $1 million per day, optimization of the chemical decontamination process, both in terms of timing and cost, is very important. The time period between decontamination cycles will vary depending upon the particular plant and the materials that were used in constructing that plant. Older nuclear plants utilize more expensive materials that did not give rise to many of the corrosion problems that have arisen with subsequent plants.

In order to utilize the two current decontamination process technologies (CAN-DEREM and LOMI), as well as any other future chemical processes that are developed, the operating capability of the RCS of a nuclear reactor, and of any auxiliary systems associated with the RCS, must be adaptable to the requirements of these chemical processes in terms of flow, temperature, pressure, and mass inventory. Ideally, this should be accomplished with as few hardware and operational changes as possible.

Another significant question in considering full RCS decontamination is whether or not the process should be conducted with the fuel in or out of the reactor. The industry is currently trying to qualify a process for decontamination without spent fuel in the reactor vessel. The additional cost and analysis necessary to resolve these safety concerns for decontamination with fuel in place makes the decontamination of the fuel a non-preferred option at the present time. Nevertheless, after a decontamination is performed without fuel in the vessel, the next step would be to investigate the possibilities for qualifying with fuel in. Therefore, any decontamination design should allow for the possibility of fuel-in decontamination.

The primary interface requirements that must be met to integrate current chemical decontamination processes with a nuclear steam supply system include at least the following: (1) temperature control in the range of 150°-240° F. (65°-115° C.) for proper utilization of the chemical processes involved; (2) provision for a number of discrete steps requiring injection and subsequent removal of chemicals; and (3) provision for continuous chemical circulation to ensure a uniform system chemistry, temperature, and a minimum system velocity during chemical decontamination processing.

Current decontamination processes require approximately 99% removal of the particular chemicals in each of several process steps. Since the RCS cannot be "transfused," i.e., have total replacement of processed fluid, because of its large volume (on the order of 100,000 gallons (380 cubic meters)), a feed and bleed process is required. Standard mass balances around the processing system establish a processing rate relationship with processing time that reaches a point of diminishing return around 1,000 gallons (3,800 liters) per minute. Flow rates of this magnitude will typically provide system clean-up to an acceptable level in about 7 hours. Thus, the interface with the clean-up system must provide a flow of this magnitude. In addition, the interface will have to provide a means to cool the flow as well as a driving head to return the flow to the RCS. As existing Chemical and Volume Control Systems (CVCS) have capacities of only about 120 gallons (450 liters) they are clearly inadequate for optimum chemical decontamination. Thus, an alternate means for supplying the required flow and cooling must be utilized.

In addition to the interface requirements listed above, an optimum chemical decontamination process will also preferably meet the following criteria: (1) an outside containment location due to the significant building space and time required for constructing such process equipment, which is typically beyond any space available inside containment, and to allow easy access for removal of solid waste; (2) providing for cooling of processed fluids prior to chemical removal in order to optimize demineralizer performance (preferable operating temperatures for resin beds are on the order of 140° F. (60° C.)); and (3) maximization of use of existing equipment and connections to the primary system in order to minimize overall cost.

The apparatus and method of the present invention meets each of the necessary and preferred criteria and optimizes the chemical decontamination process as a whole. It has been discovered that the residual heat removal (RHR) system is the optimum interface for the decontamination processing system. The proposed configuration, described below, requires only one additional containment penetration, supplies more than adequate cooling capacity by use of the RHR heat exchanger, and provides more than adequate pressure by use of the RHR pump to drive the process flow to, and through, the processing system and to return it to the RCS.

The CAN-DEREM process requires temperatures of 240° F. (116° C.)±10° F. (6° C.) and 194° F. (90° C.)±10° F. (6° C.) depending upon the particular chemical step. The LOMI process requires a constant temperature of 194° F. (90° C.)±10° F. (6° C.). Thus, the chemical decontamination system interfacing with the primary system must be capable of withstanding temperatures of approximately 250° F. (120° C.). Nevertheless, even though the chemical decontamination processes require a slightly elevated temperature, the primary system must be totally cooled down to remove fuel if the decontamination is to be performed with the fuel out. Thus, typical preliminary steps will involve total system cool down, fuel removal, and reheating of the primary system up to the appropriate temperature for decontamination. If the decontamination process is to proceed with the fuel in place, it is only necessary to cool down the primary system to the appropriate decontamination temperature. Decontamination with fuel in place can result in a time savings of up to 15 days of avoided outage time since the need for total cool-down and fuel removal is eliminated. The RHR system is typically used only during cool down or start up of the nuclear reactor. Even then, the RHR system is not activated until the reactor temperature has decreased to approximately 350° F. (175° C.). Prior to that point, heat is removed by dumping steam.

Turning now in detail to the drawing, where like numbers refer to like items, the single FIGURE represents a schematic flow diagram of one preferred embodiment of the present invention. Other configurations are possible and do not affect the method and apparatus of the present invention.

Processed fluids from the RCS 10 of a nuclear reactor are fed to the RHR system 11 by means of a pair of RHR pumps 12. The chemical decontamination processes occur at a temperature in the range of 15°-240° F. (65°-115° C.), as discussed above. Nevertheless, the decontamination removal system proposed to be used optimally should operate at a temperature in the range of 140° F. (60° C.). (Such a decontamination removal system is described in detail in co-pending application Ser. No. 07/62/129, entitled "Clean-up Sub-system For Chemical Decontamination Of Nuclear Reactor Primary Systems," and incorporated herein by reference.)

Thus, heat removal prior to decontaminate removal is required. Heat removal will occur by steady state heat losses and, further, by cooling of the process fluids in one or more RHR heat exchangers 14 and 15. Since an RHR pump 12 is typically designed for pumping on the order of 3,000 gallons (11.4 cubic meters) per minute, only one RHR pump 12 would be required to provide the 1,000 gallons (3.79 cubic meters) per minute process flow desired within the decontamination process. The second RHR pump 12 would be reserved as a back-up. In a typical arrangement, one RHR pump 12 and RHR heat exchanger 14 would be dedicated to cooling the process flow 10 while the second RHR pump 12 and RHR heat exchanger 15 would remove any excess heat required to maintain a proper heat balance in the RCS 10. The scheme can be utilized with or without the fuel installed.

In operation, a reactor coolant pump, or pumps, part of the RCS 10, provides a source of heat, in conjunction with any decay heat from the reactor core (if installed), to establish appropriate operating temperatures for the chemical decontamination throughout the RCS 10, as well assisting in circulation of the coolant. The reactor coolant pumps are the only source of heat if the core is removed during decontamination. In addition, operation of at least one reactor coolant pump is required for circulation, since the flow from the auxiliary RHR pumps 12 cannot ensure uniform chemistry and temperature in the RCS 10 as a whole.

If it were possible for one RHR train of an RHR pump 12 and the RHR heat exchanger 15 to keep up with decay and reactor coolant pump heat input shortly after standard RHR initiation at approximately 350° F. (175° C.), then the other RHR train could be isolated and the tap-off to the chemical processing system installed while the other RHR train cooled the RCS from 350° F. to 240° F. (175° C. to 116° C.). Thus, with reference to the drawing, valves 16 and 20 would remain open to allow process fluid flow cool-down in RHR heat exchanger 15 while valves 18 and 22 would be closed to isolate the RHR heat exchanger 14 and its accompanying piping for installation of the chemical decontamination processing system. Using such a single RHR train for cool-down, a temperature of 240° F. (116° C.) will typically be reached within approximately 25 hours after reactor shut-down. Alternatively, if two RHR trains are available, the target temperature will be reached within about 6 hours after shut-down.

To connect the chemical decontamination system 34 to the RHR system 11, a tap-in line 28 is connected just downstream of RHR heat exchanger 14. Valves 24 and 26 can be operated to divert flow from the RHR system 11 to the chemical decontamination system 34 when desired.

In order to minimize penetration of the containment structure of the nuclear reactor 30, in one preferred embodiment, the process line leading to the high head safety injection pumps 32 is utilized for flow to the chemical decontamination system 34. Valves 36 and 38 in conjunction with connection piping 40 are used to divert process fluid flow from the high head safety injection pump line 32 to the chemical decontamination system 34. After passing through the chemical decontamination system 34, wherein dissolved contaminant metals and suspended contaminant solids are removed by means of demineralizers and filters as more fully described, for example in co-pending application Ser. No. 07/62/129, decontamination chemicals are thereafter injected as needed using injection means 35 and the process fluids are returned to the RHR system 11, and thereafter to the cold leg injection 44 by means of return line 42.

An alternative method of utilizing the RHR system 11 is to tap off of the discharge of RHR pumps 12 outside of containment structure 30 and direct the flow directly to the processing system 34 and injection means 35, returning the processed fluids to the primary system by means of the high head safety injection pump line 32. This method would save a containment penetration, but would also require another heat exchanger along with a sizeable cooling water supply in order to reduce the process fluids temperature sufficiently to optimize use of the chemical decontamination resin beds. The cost of this option would typically be much higher than that of the preferred embodiments described herein.

In addition to the primary interfacing of the chemical decontamination system 34 and injection means 35 with the RCS 10, additional sources of decontaminated fluids can be directed to the chemical decontamination system 34. While pump seal leakage is a constantly occurring phenomenon during nuclear reactor operation, the leakage becomes critical during decontamination since the leaked fluids will contain chemicals and activated crud. Thus, leak-offs from the reactor coolant pump #2 seals, valve leak-offs, and miscellaneous equipment drains are all typically directed to a reactor coolant drain tank 46 via line 48. The contents of the reactor coolant drain tank 46 would normally be directed thereafter to the boron recycle system holdup tanks 50 by means of one or more reactor coolant drain tank pumps 52. In conjunction with the apparatus of the present invention, however, the stream can preferably be diverted by means of valves 54 and 56 and combined with flow from the reactor coolant pump #3 seal leakoffs 58 that has been collected in containment sump 60 and pumped thereafter by containment sump pump 62 in line 64. The combined streams can be directed to the waste disposal system holdup tank 66, but are preferably diverted by valve 68 and 70 to the chemical decontamination system 34. Once in the chemical decontamination system 34, the combined stream of fluid can either be purified and returned to the primary system via return line 42, or removed with other decontamination wastes, thus minimizing the risk of personnel radiation exposure.

Operation of one or more reactor coolant pumps, as called for in a preferred embodiment of the present invention, requires a minimum pressure in the RCS system 10 of approximately 400 psig (29 $Kg/cm^2$) to ensure proper operation of the reactor coolant pump #1 seal. During normal plant operation, the RCS pressure is controlled using a steam bubble in the primary system pressurizer. However, the use of a steam bubble during decontamination is not feasible because the steam saturation temperature at 400 psig (29 $Kg/cm^2$) of 447° F. (230° C.) is too high to be used with either of the current decontamination processes, which call for temperatures in the 150°-240° F. (65°-116° C.) range. The higher temperature would not only preclude the circulation of decontamination chemicals throughout the spray lines and into the pressurizer, but would result in accelerated corrosion rates of several RCS materials of construction.

In some cases, pressure can be controlled with the pressurizer "water solid" during the latter stages of plant cool-down and the initial stages of plant heat-up. Water solid pressure control, however, is not a desirable method of pressure control for long periods of time such as are required for full decontamination (days), since minor system perturbations will result in a significant pressure transient.

Because of the problems with steam or water-solid pressure control, an alternative means for pressurizing the RCS 10 during chemical decontamination is required. In one preferred embodiment of the present invention, a nitrogen gas bubble in the pressurizer, which is part of the RCS 10, is used to maintain system pressure at, or above, the necessary pressure at the lowered temperatures required for decontamination. An air bubble is not feasible because of the very stringent dissolved oxygen requirements for both the CANDEREM and LOMI processes. Nitrogen is preferable because of its inertness, general availability, low cost, and low impact if venting to the containment atmosphere were to become necessary. In addition, the quantity of nitrogen required is available on-site by installing a temporary cross-connection between the pressurizer and a safety injection system accumulator nitrogen supply line.

In order to utilize a nitrogen bubble, nitrogen is admitted to the gas space of the pressurizer in the RCS 10 during the RCS cool down from 350° F. (175° C.). Spray flow condenses the steam and slowly drops the pressure. The pressure drop is compensated for by the nitrogen. Alternatively, the high pressure accumulator fill line can be routed to the pressurizer.

Nitrogen pressure control permits full circulation through the pressurizer so that the spray lines, pressurizer, and surge line can be decontaminated and maintained in thermal equilibrium with the RCS loops. The nitrogen bubble will not preclude substantial decontamination of the pressurizer, since most of the activated crud will accumulate in the bottom of the pressurizer vessel. However, maximum spray flow should preferably be maintained. Thus, by using a nitrogen bubble, high pressure at the lower temperatures required for chemical decontamination is readily achieved.

As an additional result of the relatively high pressures required for RCS operation during chemical decontamination, the potential exists for steam generator tube leakage into the secondary system. Such leakage is undesirable since it allows process fluids containing crud and other decontamination chemicals into the secondary system. Such leakage can preferably be prevented by pressurizing the shell side of the steam generators to a pressure above the primary system pressure, thereby precluding leakage from the primary side to the secondary side. One method of easily accomplishing such higher secondary side pressures is to maintain the secondary side water-solid during decontamination. Secondary side pressure can be maintained with a small positive displacement pump connected to a sampling or blow down line.

Some allowance, as would be known to those of ordinary skill in the art, must be made to maintain proper mass inventory within the primary system during chemical decontamination. Thus, the normal let-down and charging path of the CVCS of the nuclear reactor primary system will preferably remain in service during decontamination in order to maintain RCS mass inventory and to provide seal injection cooling for the reactor coolant pumps. The typical let-down system capability, including storage in the CVCS holdup tanks, is more than adequate to compensate for any chemical addition associated with either of the current decontamination processes. This is true even if clean seal injection is required from either the refueling water storage tank or from the primary makeup water storage tank.

Thus, a system for integrating a chemical decontamination system within a nuclear reactor primary system has been disclosed that optimizes use of existing equipment, minimizes containment penetration, and optimizes the time required for decontamination. It utilizes known technology in a unique arrangement to provide chemical decontamination in a timely manner so as to minimize the overall scheduled requirements for large, full system decontamination.

Having thus described the invention, it is to be understood that the invention is not limited to the embodiments set forth herein for purposes of exemplification. It is to be limited only by the scope of the attached claims, including a full range of equivalents to which each claim thereof is entitled.

What is claimed is:

1. A method of chemically decontaminating a nuclear reactor primary system, having a residual heat removal system with one or more residual heat removal heat exchangers, each having an upstream and a downstream side, at or above ambient pressure comprising the steps of:

injecting decontamination chemicals using an injection means into a process fluid flow that flows into the residual heat removal system at a point downstream of one of the residual heat removal heat exchangers;

circulating the injected decontamination chemicals throughout the primary system using one or more reactor coolant pumps in conjunction with one or more residual heat removal pumps;

directing the circulated decontamination chemicals and process fluids to a means for removing suspended solids and dissolved materials after said circulated chemicals and process fluids have passed through the residual heat removal heat exchanger but before they reach the point at which the process fluid flow with injected decontamination chemicals flows into the residual heat removal system;

decontaminating the process fluids by removing suspended solids or dissolved materials from the process fluids in the means for removing suspended solids and dissolved materials; and feeding the decontaminated process fluids to the injection means.

2. The method of claim 1 further comprising the step of utilizing one or more of the reactor coolant pumps to provide heat to the chemical decontamination system.

3. The method of claim 1 further comprising the step of maintaining the pressure of the primary system at, or above, 400 psig using a nitrogen blanket within a system pressurizer.

4. The method of claim 1 wherein a secondary system of the nuclear reactor is maintained at a pressure higher than the pressure of the primary system in order to prevent leakage of process fluids from the primary system into the secondary system.

5. The method of claim 1 further comprising the step of feeding the contents of a containment sump of the primary system to the means for removing suspended solids and dissolved materials.

6. The method of claim 1 further comprising the step of feeding the contents of a reactor coolant drain tank of the primary system to the means for removing suspended solids and dissolved materials.

7. A method of integrating a chemical decontamination system, having an inlet and an outlet, into a nuclear reactor primary system, having a residual heat removal system with one or more residual heat removal heat exchangers having an upstream and a downstream side, comprising the steps of:

connecting the inlet of the chemical decontamination system, which operates at, or above, ambient pressure, to the residual heat removal system at a location downstream of a residual heat removal heat exchanger;

connecting the outlet of the chemical decontamination system to the residual heat removal system at a location downstream of the connection to the inlet of the chemical decontamination system; and pumping primary system fluids through the residual heat removal heat exchanger and to the chemical decontamination system using a residual heat removal pump.

8. The method of claim 7 further comprising the step of utilizing one or more reactor coolant pumps of said nuclear reactor primary system to provide heat and additional pumping power to the chemical decontamination system.

9. The method of claim 8 further comprising the step of maintaining the pressure of the primary system at, or above, 400 psig using a nitrogen blanket within a system pressurizer.

10. The method of claim 7 wherein a secondary system of the nuclear reactor is maintained at a pressure higher than the pressure of the primary system in order to prevent leakage of process fluids from the primary system into the secondary system.

11. The method of claim 7 further comprising the step of feeding the contents of a containment sump of the primary system to the chemical decontamination system.

12. The method of claim 7 further comprising the step of feeding the contents of a reactor coolant drain tank of the primary system to the chemical decontamination system.

13. A chemical decontamination system for use at, or above, ambient pressure in a nuclear reactor primary system having a residual heat removal system comprising:

means for injecting decontamination chemicals into the primary system;

means for removing dissolved and suspended materials and decontamination chemicals from the primary system located at an upstream side of the means for injecting decontamination chemicals;

one or more residual heat removal pumps for pumping primary system fluids through the residual heat removal system, which includes one or more residual heat removal heat exchangers having upstream ends and downstream ends;

means located downstream of one of the residual heat removal heat exchangers connecting the residual heat removal system to the means for removing dissolved and suspended materials and decontamination chemicals from the primary system; and a return line connecting the means for injecting decontamination chemicals to the residual heat removal system at a point downstream of the means connecting the residual heat removal system to the means for removing dissolved and suspended materials.

14. The chemical decontamination system of claim 13 further comprising a pressurizer connected to the primary system capable of maintaining the pressure of the primary system at, or above, 400 psig by use of a nitrogen blanket.

15. The chemical decontamination system of claim 13 wherein one or more of a reactor coolant drain tank or a containment sump, which collect process fluids from the primary system are additionally connected to the means for removing dissolved and suspended materials and decontamination chemicals from the primary system.

16. The chemical decontamination system of claim 13 wherein the means for injecting decontamination chemicals into the primary system and the means for removing dissolved and suspended materials and decontamination chemicals from the primary system are located outside of a containment structure surrounding the primary system.

17. A nuclear reactor having a primary system wherein the primary system has a residual heat removal system and a chemical decontamination system that operates at, or above, ambient pressure comprising:

means for injecting decontamination chemicals into the primary system;

means for removing dissolved and suspended materials and decontamination chemicals from the primary system located at an upstream side of the means for injecting decontamination chemicals;

one or more residual heat removal pumps for pumping primary system fluids through the residual heat removal system, which includes one or more residual heat removal heat exchangers having upstream ends and downstream ends;

means located downstream of one of the residual heat removal heat exchangers connecting the residual heat removal system to the means for removing dissolved and suspended materials and decontamination chemicals from the primary system; and a return line connecting the means for injecting decontamination chemicals to the residual heat removal system at a point downstream of the means connecting the residual heat removal system to the means for removing dissolved and suspended materials.

18. The nuclear reactor of claim 17 further comprising:

a pressurizer connected to the primary system capable of maintaining the pressure of the primary system at, or above, 400 psig by use of a nitrogen blanket.

19. The nuclear reactor of claim 17 wherein one or more of a reactor coolant drain tank or a containment sump, which collect process fluids from the primary system are additionally connected to the means for removing dissolved and suspended materials and decontamination chemicals from the primary system.

20. The nuclear reactor of claim 17 Wherein the means for injecting decontamination chemicals into the primary system and the means for removing dissolved and suspended materials and decontamination chemicals from the primary system are located outside of a containment structure surrounding the primary system.

* * * * *